US005992619A

United States Patent [19]

Milano

[11] Patent Number: 5,992,619

[45] Date of Patent: Nov. 30, 1999

[54] PACKAGE FOR PRODUCTS SUCH AS FOOD PRODUCTS

[75] Inventor: Giuseppe Milano, Alba, Italy

[73] Assignee: Soremartec S. A., Belgium

[21] Appl. No.: 09/182,465

[22] Filed: Oct. 30, 1998

[30] Foreign Application Priority Data

Nov. 11, 1997 [EP] European Pat. Off. ..... 97119707

[51] Int. Cl.[6] ..... B65D 77/00

[52] U.S. Cl. ..... 206/216; 206/542; 220/4.25

[58] Field of Search ..... 206/216, 542; 220/4.24, 4.25, 270

[56] References Cited

U.S. PATENT DOCUMENTS

| | | | |
|---|---|---|---|
| 3,367,490 | 2/1968 | Jensen et al. . | |
| 3,851,571 | 12/1974 | Nichols | 206/542 |
| 4,465,190 | 8/1984 | Cillario | 206/216 |
| 4,811,846 | 3/1989 | Bottega | 206/542 |
| 4,848,541 | 7/1989 | Paliotta et al. . | |
| 5,158,209 | 10/1992 | Reil et al. | 220/4.24 |
| 5,728,414 | 3/1998 | Terrasi . | |

FOREIGN PATENT DOCUMENTS

| | | |
|---|---|---|
| 1422470 | 10/1971 | Australia . |
| 3314097 | 12/1983 | Germany . |
| 97 14316 | 4/1997 | WIPO . |

*Primary Examiner*—David T. Fidei
*Attorney, Agent, or Firm*—Rothwell, Figg, Ernst & Kurz

[57] ABSTRACT

The packaging comprises two generally hollow half-shells connected to each other in face-to-face relationship along their associated mouth edges. At least one, and preferably both of the aforesaid half-shells are closed by associated sealing sheets the connection of which on the facing surfaces leads to the connection of the two half-shells. Both of the half-shells as well as the sealing sheet or sheets are provided with projections for use in opening the packaging, formed in correspondence with the mouth edges of the half-shells so as to be aligned with and superimposed over each other in the finished packaging. The connection of the sealing sheet or sheets to the associated half-shell also includes the aforesaid tongue parts which are not, however, affected by the connection of the two half-shells to each other. Consequently, the half-shells can be separated from each other without the risk of unwanted separation of the sealing sheet or sheets from the half-shells, which sheets are intended to be removed subsequently in order to access the contents of the half-shells. The connection between the various parts is preferably achieved by means of ultrasonic sealing.

21 Claims, 3 Drawing Sheets

PACKAGE FOR PRODUCTS SUCH AS FOOD PRODUCTS

BACKGROUND AND SUMMARY OF THE INVENTION

The present invention concerns packaging according to the preamble to claim 1.

Packaging of this type is known, as disclosed, for example, in U.S. Pat. No. 5,728,414. In particular, FIG. 4 of this patent illustrates packaging comprising two ovoid half-shells made from plastics material, one containing an edible product and the other containing an accessory such as, for example, a so-called "surprise". At least one of the half-shells is closed by a cover in the form of a sheet-like diaphragm attached to the mouth part of the half-shell itself. The two half-shells are then connected together in a face-to-face relationship to form a generally egg-shape shape packaging.

The two half-shells are provided with mutually off-set, projecting tongues in correspondence with the flanged edges which enable their coupling. These tongues can be grasped by the user in order to separate the half-shells. Where the half-shell is closed by a sheet, the associated tongue is—as it were—double, in that it is present both on the mouth edge of the half-shell as well as—in an exactly corresponding position—on the sealing sheet. In a manner substantially similar to the operation for separating the half-shells described above, the user can separately grasp the tongue on the half-shell and the tongue on the sheet and pull on them directly in order to detach the sealing sheet from the mouth edge of the half-shell.

The Applicant has been able to show that the preceding arrangement, although fully satisfactory, can be further improved in various ways.

In the first place, it is necessary to ensure that the sequence of operations for opening the packaging always occurs in the order described above.

It is thus necessary to avoid, for example, the sealing sheet of the half-shell containing the food product becoming detached from the associated half-shell before the half-shells themselves are separated. The same problem arises in the case of a further possible embodiment in which both half-shells of the packaging are closed by associated sealing sheets.

It is also desirable, even though the separation of the two half-shells occurs first, to avoid this giving rise to unwanted detachment, even partial detachment, of the sealing sheet of the half-shells, in particular, of the half-shell containing the edible product. Packaging such as that described in U.S. Pat. No. 5,728,414 is, in fact, intended primarily for young consumers who often attempt immediately to open the half-shell containing the surprise, leaving the consumption of the edible product in the other half-shell until later. This half-shell may therefore be put to one side, at least momentarily, for example, by putting it in a pocket. The possible at least partial detachment of the associated seal may give rise to the unwanted escape of the edible product from the regions where the associated sealing sheet has become detached.

General hygienic requirements make it preferable for the half-shell containing the edible product to remain sealed until the user positively opens it by removing the associated sealing sheet in order to consume the edible product. The same considerations apply substantially to the other half-shell containing the surprise, it being preferable that the consumer is able initially to separate the two half-shells without having to worry about the surprise immediately falling out. For this reason, it is usually preferred that the half-shell containing the surprise, like the half-shell containing the edible product, also has an associated sealing sheet. In this way, once the two half-shells are separated, the user (usually of young age) is able calmly to proceed to open the half-shell containing the surprise, holding the half-shell facing upwards in the palm of one hand and removing the sealing sheet with the other hand. This method significantly reduces the risk of the surprise accidentally falling out.

It has also been shown that locating off-set tongues on the two half-shells can cause an unwanted rotation of the packaging while the two half-shells are being separated.

The need to ensure a predetermined sequence for the separation of the various component parts of the packaging (half-shells and associated sealing sheets) could be at least substantially resolved by markedly differentiating the connecting forces between the various parts. At least in theory, for example, the face-to-face connection between the two half-shells could be made such that the connection between corresponding half-shells is weaker than the connection to or between each sheet. To be truly effective, such a differentiation would carry a serious risk of leading to the unwanted separation of the half-shells before the user wishes effectively to open the packaging in order to consume the product or—on the other hand—to a connection force between the sealing sheet and the half-shell that would make it difficult to detach the sheet from the half-shell. In relation to this latter aspect, it should be taken into account that, on the one hand, the user is frequently a very young person who is unable to exert a significant force with his or her hands and, on the other hand, the application of a very decisive force in the separation operation can lead to the unwanted deformation of the half-shell.

In relation to this, it has been shown that the methods of connection usable in this particular context (the half-shells and sealing sheets in question usually being formed from plastics material) do not generally allow, given the high production rates, a very close graduation in the resistance to separation to be achieved from the connection action. This consideration is particularly applicable to heat sealing techniques.

The object of the present invention is to provide an arrangement capable of satisfying in an excellent manner all of the requirements outlined above.

According to the present invention, this object is achieved by virtue of packaging having the characteristics set out in the following claims. The invention also concerns the associated manufacturing process.

BRIEF DESCRIPTION OF THE DRAWINGS

The invention will now be described, purely by way of non-limitative example, with reference to the accompanying drawings, in which.

DETAILED DESCRIPTION OF THE PREFERRED EMBODIMENTS

Figure 1:
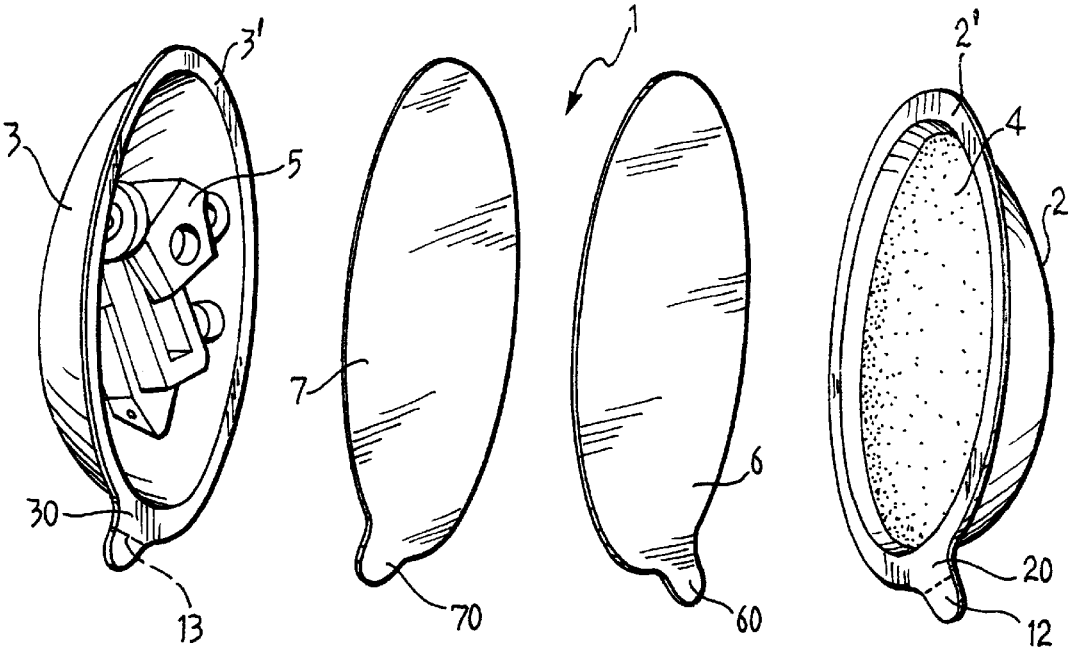
FIG. 1 is a general exploded, perspective view of packaging according to the invention.

In FIG. 1, the reference numeral 1 indicates packaging for a food product substantially comparable to that described in U.S. Pat. No. 5,728,414. For a more detailed illustration of the characteristics of this packaging, the criteria which prompted its production and the associated method of use, reference may be made to the detailed description in this earlier application.

In order to understand the present invention, it is sufficient to remember that the packaging 1 includes, in the embodiment illustrated here, two half-shells 2, 3 capable of containing, respectively, an edible food product 4 and an accessory 5 such as, for example, a toy intended to be a "surprise". Both half-shells are provided with flanged edges 2', 3' along their associated mouth parts, which edges enable the half-shells 2 and 3 to be closed by sealing sheets 6 and 7 after they have been filled. The two filled and closed half-shells are then connected to each other in face-to-face relationship. This can be achieved, for example, by means of an attachment action effected along the peripheral parts of the sealing sheets 6, 7 which extend along the flanged edges 2' and 3'.

The choice of materials for the half-shells 2, 3 and the associated sealing sheets 6, 7 can be very wide. To this end, it is possible to use, for example, any plastics material, laminated if necessary, suitable for contact with food products —at least as regards the inner surfaces of the half-shell 2 and the associated sheet 6, which face the food product 4. The same materials thus allow the possible attachment of all of the relevant parts using techniques such as heat sealing or—according to a preferred embodiment of the invention—ultrasonic sealing. The most suitable materials for this purpose are polyvinylchloride and polyethylene, preferably combined (for example, in the form of laminated materials) so that the same material is on the two surfaces intended to be sealed together. A material such as a polyamide may advantageously be provided on the outer surfaces of the half-shells 2 and 3, which usually have writing, embossments and various decorative patterns thereon.

It will therefore be appreciated that in the finished packaging 1, three seams or joining regions are typically present, namely:

- the connection between the edge 2' of the half-shell 2 and the associated sealing sheet 6,
- the connection between the edge 3' of the half-shell 3 and the sealing sheet 7, and
- the connection between the two sealing sheets 6 and 7 and the associated facing surfaces of the half-shells 2 and 3.

As has already been said in full in the introduction to the present description, opening the packaging assumes a precise sequence for the release of the aforesaid connections in order for it to be carried out correctly.

To this end, the half-shells 2 and 3, as well as the associated sealing sheets 6 and 7, are provided with projecting tongues indicated respectively with the reference numerals 20, 30, 60 and 70. These tongues are intended, in the finished packaging, to be aligned with and superimposed over each other, and thus not even partially off-set as in the packaging illustrated in U.S. Pat. No. 5,728,414.

Figure 3:
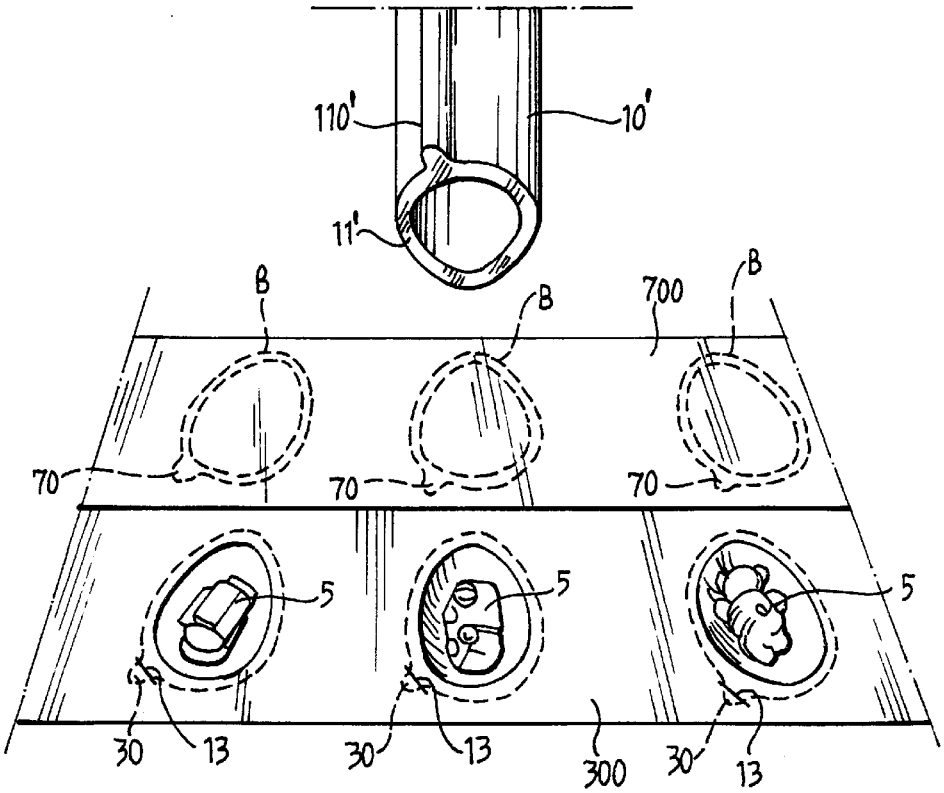
FIGS. 2 to 4 show successive stages in the associated manufacturing process.
Figure 2:
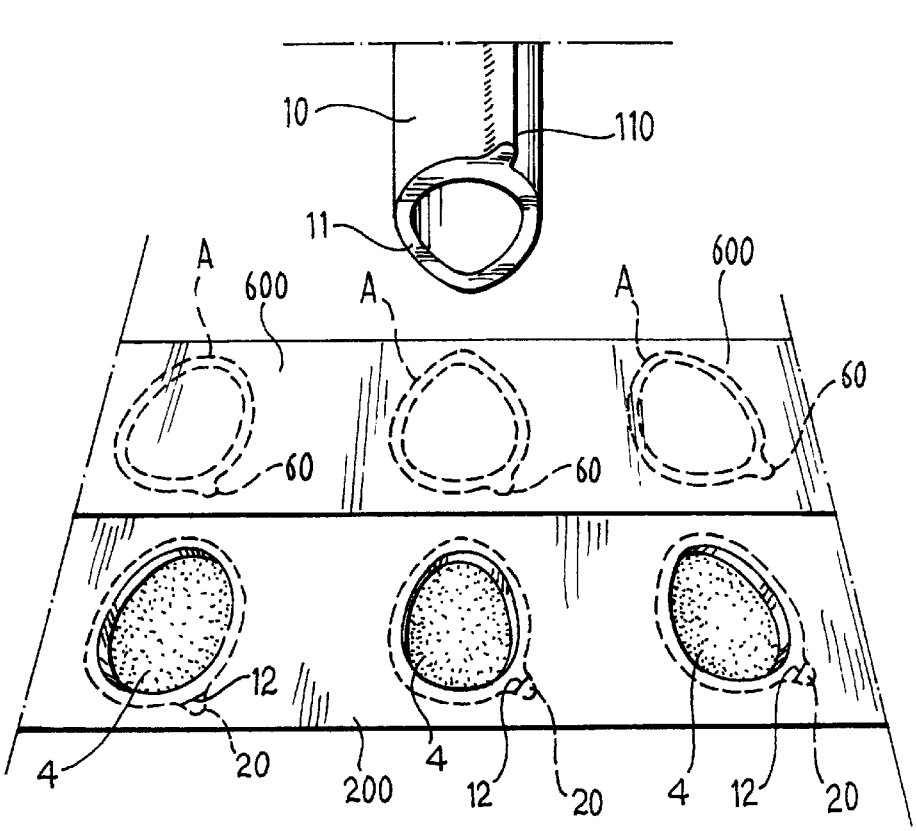

FIGS. 2 and 3 illustrate the generally similar criteria adopted for the manufacture of the half-shells 2 and 3, and their closure with the sealing sheets 6 and 7.

Referring initially to FIG. 2, the half-shells 2, 3 are preferably formed from a sheet of material indicated 200 in which, by means of a thermoforming operation (according to known criteria), depressions corresponding to the spherical parts of the associated half-shells 2 are initially formed.

Food products 4 have previously been introduced into the depressions (also according to known criteria).

The sealing sheet 6 is also made from a sheet of material 600. This is applied to the sheet of material 200 to form the connection between the two materials 200 and 600 in question along the edges of the depressions formed in the material 200. The connection is preferably made using an ultrasonic technique which utilises a generally hollow sonotrode 10 (for example, having a tubular structure) the shape of the active part 11 of which corresponds to the extent of the surface areas A where the connection between the edge parts of each half-shell 2 and the associated sealing sheet 6 is to be formed. The shape of these areas is indicated in broken outline in FIG. 2.

Looking at the shape of the sonotrode 10 and the extent of the areas A, it will be appreciated that the aforesaid ultrasonic coupling is achieved (according to criteria known to experts in the field of ultrasonic sealing) in such a way as to include areas corresponding both to the tongue 20 (in the case of the half-shells 2) and the tongue 60 (in the case of the sheet 6) in the connection. To this end, the sonotrode 10 has a suitable tongue-like projection 110.

In other words, the tongue 60 of the sheet 6 is ultrasonically sealed to the tongue 20 of the half-shell 2 in the finished packaging. The reference numeral 12 indicates a continuous or broken cut line formed in a flat blank of the sheet-like material 200 in correspondence with each part intended to form a half-shell 2. Specifically, the line 12 is formed so as to cross the entire area corresponding to that which will form the tongue 20 in the finished product. The reasons for the presence of the cut line 12 will become clearer below.

From FIG. 2, it will also be appreciated that the operation for sealing the sheet 600 to the sheet 200, that is, the application of the sheet 6 to the half-shell 2, is preferably achieved by acting on the sheet 600 with the sonotrode 10, thus acting from the side of the sheet 6. Experiments conducted by the Applicant show that this arrangement is preferred to the arrangement—nevertheless possible—of effecting the ultrasonic sealing by acting from the opposite side, that is, using the sonotrode 10 on the sheet 200 in which the depressions for containing the food products 4 are formed.

FIG. 3 illustrates the manufacture of the half-shells 3 containing the surprises 5. The sequence of operations for this is performed according to criteria substantially identical to those illustrated in FIG. 2 with reference to the half-shells 2.

In this case also, a sheet of material 300 is used in which, by means of a thermoforming operation, the depressions into which the surprises 5 will subsequently be placed are formed. As this is according to known criteria, it does not require detailed illustration. The sheet of material 700 corresponding to the sealing sheet 7 is welded to the sheet material 300, this also using an ultrasonic technique utilising a sonotrode 10' having an active area 10 with an associated tongue-like projection 110'. In this case too, in order to form the connection in the areas represented in broken outline and indicated B in FIG. 3, the sonotrode 10' preferably acts from the side of the sheet 700 corresponding to the sheet 7. This is specifically to form the connection also in correspondence with the tongues 30 and 70 provided on each half-shell 3 and each sheet 7, respectively. In this case also, the zones corresponding to the tongues 30 of the half-shells 3 are marked by continuous or broken cut lines 13 the function of which will be illustrated better below.

In consideration of the specular symmetry necessary for coupling the mouth parts of the half-shells 2 and 3, the areas A and B of FIGS. 2 and 3 must also be specularly symmetrical. This could lead to a consideration of the need to use two kinds of sonotrodes 10, 10' having specularly symmetrical active surfaces, which are therefore different from each other.

This requirement, shown explicitly in FIGS. 2 and 3, is not, however, an absolute necessity. It is, in fact, possible to utilise a single kind of sonotrode (not explicitly illustrated) having both a projection in the position occupied by the projection 110 of the sonotrode 10 of FIG. 2, as well as a symmetrical projection in the position of the projection 110' of the sonotrode 10' of FIG. 3.

Using such a sonotrode both for connecting the films 200 and 600 of FIG. 2, and the films 300 and 700 of FIG. 3, the immediate result is obtained of creating a connection, not only in correspondence with the tongues 20 and 60 (FIG. 2) and 30 and 70 (FIG. 3), but also in a symmetrical position, which connection is not intended to be retained in the finished packaging.

In any case, this unwanted connection region is eliminated when the two half-shells are trimmed along their edge parts. This operation is performed (in known way, for example, by die cutting) before, or possibly after, the connection has been formed between the two half-shells closed by the associated sealing sheets according to the method illustrated schematically in FIG. 4.

This Figure relates ideally to the connection between the two half-shells closed by associated sheets, effected after the flanged edges 2' and 3' of the two half-shells have been trimmed.

In any case, the aforesaid connection can also be made before the two half-shells are connected to each other. In this latter case, the connection operation shown in FIG. 4 will, in effect, be achieved by acting, on one side, on the film 200 to which the film 600 has been applied over the mouth parts of the associated shells and, on the other side, on the film 300 to which the film 700 has been applied.

This method of operation is at least marginally preferable in that it enables the outline of the flanged edges 2' and 3' of the finished packaging to be defined in a single cutting operation (for example, die cutting) effected when the various films 200, 600 and 300, 700 have already been connected to each other. In this way, a very precise and neat shape can be obtained without the problems of alignment which could otherwise arise in a less preferable arrangement although, for this reason, the connection between the two half-shells (as illustrated—mainly for reasons of simplicity—in FIG. 4) must be formed after the outlines of the respective mouth parts have been formed.

Figure 4:
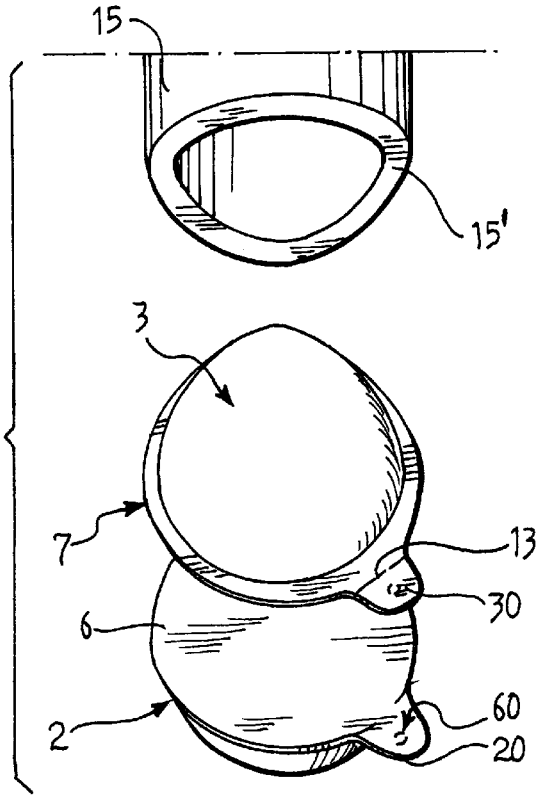

FIG. 4 shows that the connection between the two half-shells 2, 3 closed by the associated sheets 6 and 7 can also be achieved by means of ultrasonic sealing using a sonotrode 15 structurally similar to the sonotrodes 10 and 10' described above (and capable, as has already been said, of being formed using a single kind of sonotrode having two symmetrical lugs corresponding to the projections 110, 110'). Therefore, the active region 15' of the sonotrode 15 is devoid of projections such as the projections 110, 110' shown in FIGS. 2 and 3. The action of the sonotrode 15 is therefore to form a connection between the half-shells 2 and 3 by ultrasonically sealing the facing surfaces of the sheets 6 and 7, excluding the portions corresponding to the projections 60 and 70, and thus the projections 20 and 30 of the two half-shells 2 and 3.

Although the connection can be formed ultrasonically by acting on one or other of the half-shells with the sonotrode 15, experiments conducted by the Applicant demonstrate that the arrangement illustrated in FIG. 4 is generally preferred, in which the application of the ultrasonic vibrations is effected by the sonotrode 15 acting on the half-shell 3 containing the surprise 5, while the half-shell 2 containing the edible product 4 is supported by the housing element (not visible in the drawings) of the ultrasonic sealing system.

The same experiments conducted by the Applicant show that the best results, both as regards the connection of the sheets 6, 7 to the half-shells 2, 3, and the connection of the half-shells 2, 3 to each other, are obtained using sonotrodes with worked surfaces, specifically sonotrodes having a surface knurling of the type currently known as "direct step".

Figure 5:
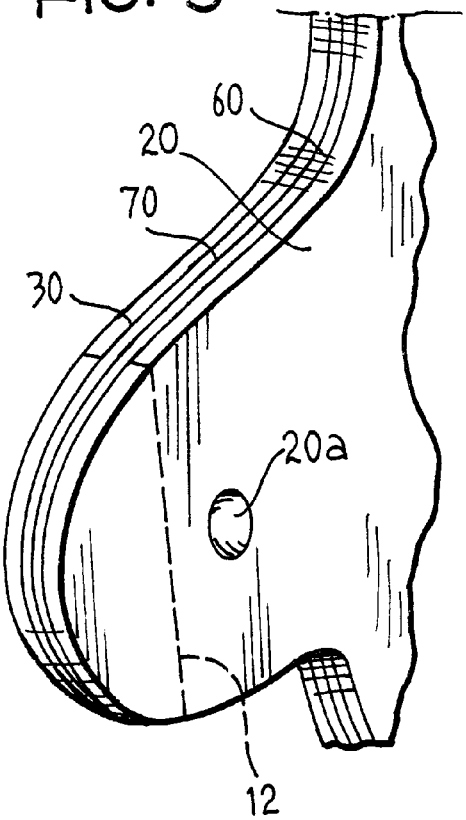
FIGS. 5 to 7 show the operations for opening the packaging itself.
Figure 6:
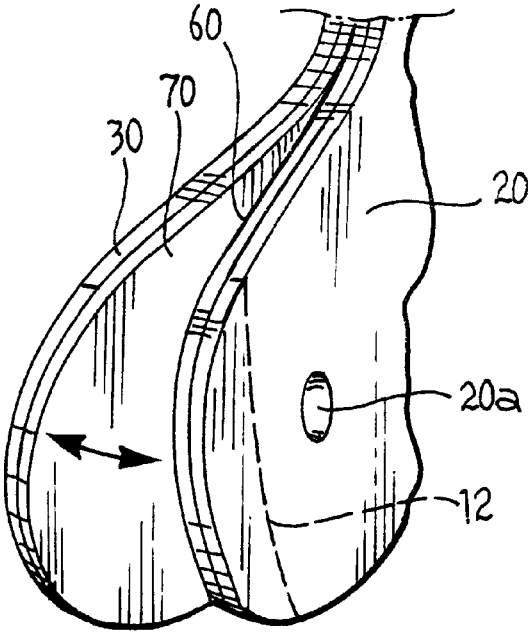

After the half-shells 2 and 3 have been connected by sealing the peripheral regions of the facing surfaces of the sealing sheets 6 and 7, the corresponding result for the tongues 20, 30, 60, 70 is as represented schematically in FIGS. 5 and 6.

In other words, the tongue 60 of the sealing sheet 6 is sealed to the tongue 20 of the edge of the half-shell 2, while the tongue 70 of the sheet 7 is similarly sealed to the tongue 30 of the edge of the half-shell 3. The two tongues 60 and 70 are not however connected to each other, but are kept slightly separated due to the presence of internally projecting parts (formed, for example, by thermoforming together with the depressions), such as the part 20a shown in FIG. 5.

Consequently, a user wishing to open the packaging 1 is easily able to part the tongue parts associated with each of the two half-shells 2 and 3 simply by separating the two tongue parts 60 and 70, which are not connected to each other as the sonotrode 15 has not acted in that region. By positioning the tongues 20 and 60 on one side and the tongues 30 and 70 on the other side, as illustrated in FIG. 6, the user is thus able to detach the sheets 6 and 7 and separate the half-shells 2 and 3.

Due to the manner in which this stress is applied, acting to separate the sheet 6 from the sheet 7 and not, therefore, applying stresses which would lead to the separation of one or other of the sheets from the corresponding half-shell, the desired result is obtained with certainty: the first opening action is, in fact, to separate the two half-shells 2 and 3 without having an adverse effect on the anchorage of the sealing sheets 6, 7 to the edges of the half-shells 2, 3. This means, in particular, that the half-shell 2 containing the edible product 4 remains sealed. This enables the user, for example, to put the half-shell 2 still sealed by the sheet 6 in a pocket in order, therefore, to be able to open the half-shell 3 without the risk of soiling or otherwise dispersing the edible product 4.

Figure 7:
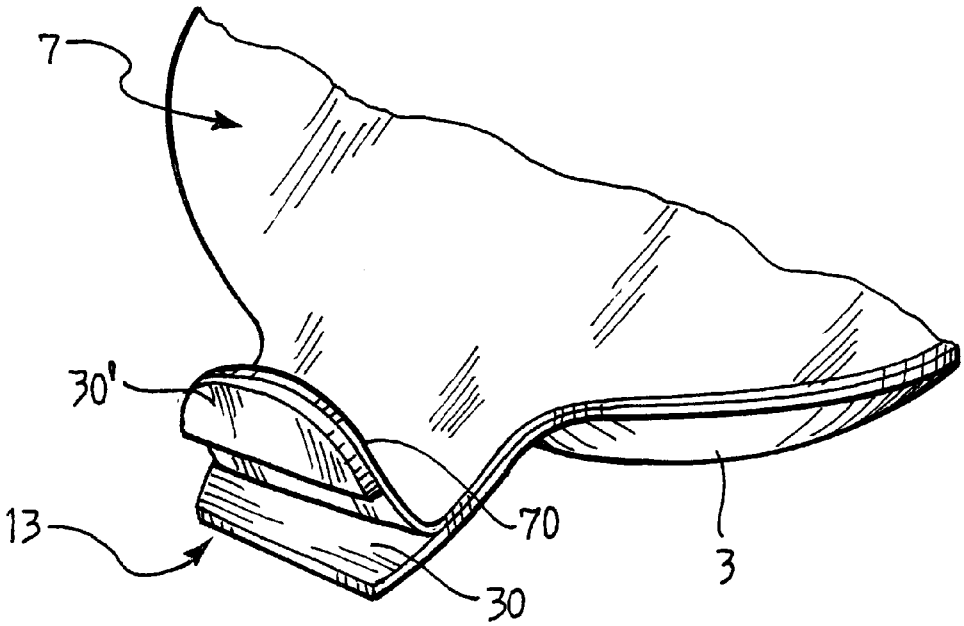

FIG. 7 schematically illustrates the opening operation capable of leading at the same time to opening of the half-shell 3 in order to gain access to the surprise 5. In this case, the presence of the cut line 13 (continuous or broken) comes into play, which cut line enables the tongue 30 to be broken and the apex parts, indicated 30', separated. The user is therefore able to grasp the corresponding apex of the tongue 70 so as gradually to detach it from the projection 30. Two tongue parts are therefore available, namely the tongue 70 and the residual part of the tongue 30, on which the user is able to act in order gradually to separate the sheet 7 from the half-shell 3.

It will be appreciated that the relative positioning of the cut line 13 could theoretically be reversed, locating it not on the tongue 30 of the half-shell 3, but on the tongue 70 of the sheet 7 (the same applying for the tongues 20 and 60). Given that the tongues 20 and 30 are thicker than the corresponding tongues 60 and 70, and given that the tongues 20 and 30 project from the packaging and are thus easily accessible, the arrangement illustrated in the accompanying drawings is preferred.

It will easily be understood that the illustration of the half-shell 3 in FIG. 7 applies identically to the half-shell 2. In this regard it is sufficient to replace the indications relating to the half-shell 3 and the sheet 7 with indications relating to the half-shell 2 and the sheet 6. This applies in particular to the tongue 20, the tongue 70 and the continuous or broken cut line indicated 13. The methods described above thus enable both half-shells 2 and 3 to be opened safely.

Experiments conducted by the Applicant demonstrate that the ultrasonic sealing techniques enable firm and secure connections to be formed between the various parts in question (in the sense that they do not give rise to unwanted separation), while enabling the various parts to be separated by the application of limited separation forces (thus capable of being exerted even by a young child) and with a gradual and regular action: the separation of the various parts is, in fact, achieved gradually without sudden detachment and/or avoiding residual parts of, for example, the sheets 6 and 7 remaining on the edge parts 2' and 3' of the half-shells 2 and 3.

Without wishing to be limited to any particular embodiment, the Applicant has reason to maintain that the use of knurled sonotrodes is particularly advantageous in achieving these results.

Naturally, the principle of the invention remaining the same, the details of manufacture and the embodiments may be widely varied with respect to those described and illustrated, without by this departing from the ambit of the present invention as defined in the accompanying claims.

What is claimed is:

1. In a packaging for a product comprising first and second cap-shape half-shells having associated mouth parts and being connected to each other along their associated mouth parts, at least one of the said half-shells being closed by an associated sealing sheet; the said first and second half-shells and the said associated sealing sheet having associated projections for a localized opening of the packaging along the said mouth parts, the improvement wherein:

the said associated projections are aligned with and superimposed over each other, and the associated projections of the said first and second half-shells are separated from each other, while the associated projection of the said at least one of the said half-shells is connected to the projection of the associated sealing sheet.

2. The packaging of claim 1, wherein both the said first and second half-shells have associated sealing sheets with the projection-like formations of the said sealing sheets being separate from each other, each being connected to the projection-like formation of the associated half-shell.

3. The packaging of claim 1, wherein at least one of the projection-like formations of the said at least one of the said first and second half-shells and the projection-like formation of the associated sealing sheet has a cut line for breaking the associated projection-like formation so as to reveal, on the projection-like formation connected thereto, a holding portion for separating the sealing sheet from the said at least one of the said first and second half-shells.

4. The packaging of claim 3, wherein the said cut line is provided on the projection-like formation of the said at least one of the said first and second half-shells.

5. The packaging of claim 1, wherein the said first and second half-shells as well as the said at least one of the said first and second half-shells and the said sealing sheet are joined by a connection obtained by ultrasonic sealing.

6. The packaging of claim 5, wherein the said ultrasonic sealing connection has a knurled pattern.

7. A method for manufacturing packaging for a product comprising first and second cap-shape half-shells having associated mouth parts and being connected to each other along respective mouth parts, at least one of the said half-shells being closed by an associated sealing sheet, the said first and second half-shells and the said sealing sheets having associated projections for a localized opening of the packaging along the said mouth parts, the method including the steps of:

locating the said associated projections in positions such that the said projections are aligned with and superimposed over each other in the finished packaging, forming the connection between the said at least one of the said first and second half-shells and the said associated sealing sheets such that the connection also includes the associated projections, and forming the connection between the said first and second half-shells in such a way that the said connection does not involve the associated projections.

8. The method of claim 7, including the steps of:

providing the said first half-shell with a first sealing sheet, connecting the associated projection-like formation of the said first sealing sheet to the associated projection-like formation of the said first half-shell, providing the said second half-shell with a second sealing sheet, connecting the associated projection-like formation of the said second sealing sheet to the associated projection-like formation of the said second half-shell, connecting the first and said second sealing sheets to each other, without the said connection including the associated projection-like formations.

9. The method of claim 7, including the operation of forming a cut line on one of the associated projection-like formations of the said at least one of the said first and second half-shells and the associated projection-like formation of the said associated sealing sheet.

10. The method of claim 9, including the operation of forming the said cut line on the associated projection-like formation of the said at least one of the said first and second half-shells.

11. The method of claim 8, including the operation of forming the said cut line on the associated projection-like formation of the said at least one of the said first and second half-shells, as well as the operation of forming cut lines on the associated projection-like formations of both the said first and second half-shells.

12. The method of claim 7, including the operation of connecting the said associated sealing sheet to the said at least one of the said first and second half-shells by ultrasonic sealing.

13. The method of claim 12, wherein the said ultrasonic sealing is achieved using a sonotrode on the said associated sealing sheet.

14. The method of claim 12, wherein the said ultrasonic sealing is achieved using a sonotrode provided with an associated projection-like formation to form the connection between the said associated sealing sheet and the said at least one of the said first and second half-shells in such a way as to include in the connection associated projection-like formations.

15. The method of claim 7, including the operation of connecting the said first and second half-shells using ultrasonic sealing.

16. The method of claim 15, for manufacturing packaging in which one of the said first and second half-shells contains an edible product, wherein the said ultrasonic sealing is achieved using a sonotrode on the said half-shell containing the edible product.

17. The method of claim 15, wherein the connection of the first and said second half-shells by means of ultrasonic sealing is achieved using a sonotrode, the active surface of which has a profile that is not superimposable over the profile of the said associated projection-like formations.

18. The method of claim 7, including the operations of:

providing the said first and second half-shells with associated sealing sheets by way of a connection action which also includes the associated projection-like formations, and forming the connection between the said first and second half-shells by connecting the said associated sealing sheets along their mutually facing surfaces in a connection action which does not include the said projection-like formation.

19. The method of claim 12, wherein the said ultrasonic sealing is achieved using sonotrode means having knurled active surfaces.

20. The packaging of claim 1, wherein said product is a food product.

21. The method of claim 7, wherein said product is a food product.

* * * * *